US005803824A

United States Patent [19]

Rollingson

[11] Patent Number: 5,803,824

[45] Date of Patent: Sep. 8, 1998

[54] GOLF PUTTER WITH LIE AND OFFSET ADAPTER

[75] Inventor: Augustin Whittingham Rollingson, Carlsbad, Calif.

[73] Assignee: Callaway Golf Company, Carlsbad, Calif.

[21] Appl. No.: 783,588

[22] Filed: Jan. 13, 1997

[51] Int. Cl.[6] ..... A63B 53/02

[52] U.S. Cl. ..... 473/246; 473/307; 473/313; 473/314; 473/340

[58] Field of Search ..... 473/131, 288, 473/292, 296, 298, 299, 305, 306, 307, 308, 309, 310, 313, 314, 231, 245, 246, 248, 251

[56] References Cited

U.S. PATENT DOCUMENTS

| | | | |
|---|---|---|---|
| 1,135,621 | 4/1915 | Roberts . | |
| 2,155,830 | 4/1939 | Howard . | |
| 3,341,203 | 9/1967 | Brill . | |
| 3,477,720 | 11/1969 | Saba | 473/245 |
| 3,980,301 | 9/1976 | Smith . | |
| 4,094,072 | 6/1978 | Erb . | |
| 4,506,888 | 3/1985 | Nardozzi, Jr. . | |
| 4,629,193 | 12/1986 | Pierman . | |
| 4,655,457 | 4/1987 | Thompson . | |
| 4,984,794 | 1/1991 | Pernelle et al. | 473/309 |
| 5,267,733 | 12/1993 | Szokola . | |
| 5,273,282 | 12/1993 | Cannon . | |
| 5,292,123 | 3/1994 | Schmidt, Jr. et al. . | |
| 5,292,128 | 3/1994 | Solheim . | |
| 5,320,346 | 6/1994 | Phillips . | |
| 5,340,104 | 8/1994 | Griffin . | |
| 5,390,918 | 2/1995 | Meyers et al. . | |
| 5,390,919 | 2/1995 | Stubbs et al. . | |
| 5,390,920 | 2/1995 | Nickum . | |
| 5,407,196 | 4/1995 | Busnardo . | |
| 5,409,220 | 4/1995 | Lombardo . | |
| 5,415,399 | 5/1995 | Kettelson . | |
| 5,439,222 | 8/1995 | Kranenberg . | |
| 5,462,279 | 10/1995 | Culpepper . | |
| 5,518,235 | 5/1996 | Mendenhall | 473/314 |
| 5,577,726 | 11/1996 | Fenton . | |
| 5,580,051 | 12/1996 | Fisher . | |
| 5,616,087 | 4/1997 | Bothwell | 473/313 |

*Primary Examiner*—William M. Pierce
*Attorney, Agent, or Firm*—Lyon & Lyon LLP

[57] ABSTRACT

A golf putter having a lie and offset adapter for selectively setting and/or adjusting the lie and offset of the putter. The adapter may comprise a spacer having a lower socket extending from a first end along a first longitudinal axis and a second socket extending from a second end along a second longitudinal axis. The length of the spacer and the orientation of the sockets are set to provide the desired lie and offset of the putter. The golf putter has a head with a face for striking a golf ball, a lower shaft segment and an upper shaft segment. The head is connected to a lower shaft segment which, in turn, is attached to the lower socket of the adapter. A lower end portion of the upper shaft segment connects to the upper socket of the adapter. Alternatively, the open end of a hosel, which extends from the putter head, may take the place of the lower shaft segment. The lie and offset of the putter are selectively set during assembly by installing an adapter configured for the desired lie and offset. The lie and offset of the putter also may be adjusted after assembly by altering or replacing the adapter.

7 Claims, 1 Drawing Sheet

GOLF PUTTER WITH LIE AND OFFSET ADAPTER

FIELD OF THE INVENTION

This invention relates to golf clubs and, more specifically, to a putter in which a lie angle and offset dimension can be selectively and/or adjustably set and to methods of assembling a putter.

BACKGROUND OF THE INVENTION

The putting stroke may be the most individual and diverse shot in golf, almost every player having his or her own unique style. Indeed, there may be nearly as many putting techniques as there are golfers. Hence, it has long been thought that, in order to optimize a golfer's putting, the golfer must have a putter that matches his or her putting stroke. In addition, a putter should be properly adapted to the physical attributes of a particular golfer, i.e., to the golfer's overall body structure as defined by the golfer's height, torso length, leg length, arm length, putting posture, etc.

Finally, there are many different playing conditions that may be considered in configuring a putter to provide maximum performance for a given golfer. For example, the speed of golf greens varies from course to course, some being very fast, some being very slow and the remainder falling somewhere in between. The primary reason for this is that different courses utilize different types of grass on their greens. Two examples of grasses commonly used on golf greens are bent grass and bermuda grass, bent grass generally providing a faster putting surface. Accordingly, a golfer may want to match his or her putter design to a particular set of green conditions being played.

It follows that there is a need for a putter that can be adjusted to fit the physical characteristics of a particular golfer, to adapt to the particulars of a given golfer's stroke, and/or can be adjusted to adapt to a given set of playing conditions.

A golf putter typically consists of a shaft having a grip fixed to one end and a putter head fixed to the other. The putter head generally has a heel, a toe, a top, a sole (or bottom), a rear side, and a face for striking the golf ball. The end of the shaft that is connected to the putter head may be inserted and fixed within a bored-through hosel that extends through the putter head, or it may be inserted and fixed within a hosel that extends from the putter head. The shape of each of these parts and the configuration of their interconnection will define the putter design and, in particular, the lie angle and offset of the putter. These two design characteristics, lie angle and offset, are generally considered to be the most important in matching a putter design to a given golfer, stroke and/or set of playing conditions.

The lie angle, commonly referred to simply as the "lie," is the angle between the horizontal and the longitudinal axis of the putter shaft, as shown by the angle 34 in FIG. 1. Setting the correct lie for an individual ensures that the putter head is angled correctly relative to the putting surface and ball during the putting stroke. To correctly strike the ball it is necessary to have the longitudinal axis of the putter head angled in the correct position relative to the putting surface. This helps to ensure that the face of the putter head strikes the ball in the correct place on the head so that the ball is struck solidly. Also, if the lie angle is too upright for a particular golfer, there is a greater risk that the toe of the putter head will catch the putting surface during a stroke and throw off the alignment of the face before the ball is struck. Similarly, a lie angle that is too flat creates a greater risk that the heel of the putter head will catch the putting surface during a stroke and throw off the alignment.

As used herein, the term offset refers to the shortest horizontal distance between the longitudinal axis of the shaft and the base edge of the face of the putter head, shown as distance 36 in FIG. 2. It will be noted that the longitudinal axis of the shaft is an imaginary line that extends beyond the shaft and, generally, in front of the face of the putter. Many golfers desire a forward offset, meaning that the shaft axis is positioned forward of the face of the putter, because this assures that the golfer's hands will be in front of the ball at the point of impact of the putting stroke. This is believed by golfer's to improve the feel and accuracy of putting by allowing the club face to strike a ball above center and, thus, to impart some overspin to the ball. Moreover, it is believed that overspin helps keep the ball on line by minimizing any skidding of the ball on the putting surface and reducing the effects of irregularities in the putting surface on the direction of travel of the ball. Some golfers also find that a forward offset makes it easier to visually align putts.

Having an offset is also believed to improve the stability of a putter during the putting stroke, especially where a putter is of a perimeter weighted design. In perimeter weighted putters much of the mass of the putter head is concentrated in the heel and toe and distributed to the periphery of the putter face. Concentrating the mass of the head in the heel and toe increases the moment of inertia of the head about the shaft axis. The offset further increases the moment of inertia by increasing the distance between the concentrated masses in the heel and toe and the axis of rotation, which is the shaft axis. This increased moment of inertia increases the putter head's resistance to twisting when a golf ball is struck offset from the center of percussion, commonly referred to as the "sweet spot," of the face of the putter. Twisting of the putter face due to an off-center hit is undesirable because it tends to cause the ball to travel off the desired line.

In light of the above, it is not surprising that several prior art putters have been developed to provide adjustment of one or more design variables so that a single putter design can be adjusted to suit the needs of a variety of individual golfers or playing conditions. In short, by developing adjustable putters, provisions may be made for tailoring a putter design to a particular set of playing conditions, to adjust for changes in the golfer's putting technique which may occur over time, or to provide compensation or correction for putting errors which may occur over an intermittent period of time. For example, one putter design having an adjustable lie angle is disclosed in U.S. Pat. No. 5,462,279, entitled "Golf Club Capable of Selective Angle Modification Between the Hosel and Head, and Selective Shaft Length and Method of Assembling the Golf Club," and issued to Culpepper. This putter design has a head and hosel interface which allows the head to be positioned relative to the shaft at a variety of angles. The interface consists of a male socket on the head which fits into a female socket on the hosel. The lie of the putter is adjusted by rotating the head relative to the hosel. A screw is used to tighten the two parts together. Friction between the male socket and the female socket prevents unwanted rotation of the head relative to the hosel which fixes the lie of the putter. Other adjustable putter designs, such as those described in U.S. Pat. No. 5,320,346, issued to Phillips and U.S. Pat. No. 2,155,830, issued to Howard, allow for the adjustment of both the lie angle and loft of the putter head. The loft is the angle formed between the plane of the face of the putter and a vertical plane, wherein the intersection of the two planes defines a line parallel to the face of the putter. In U.S. Pat. No. 5,320,346, which is entitled "Golf Putter with Adjustable Shaft," the head of the putter is connected to the shaft using a sphere which is connected to one end of the shaft and mounted in a half spherical cavity located in the head. Set screws are used to fix the sphere in place. The angle of the head with respect to the shaft is adjusted by loosening the set screws and rotating the head to the desired angle of lie and loft. In U.S. Pat. No. 2,155,830, the head is connected to the shaft by a pair of eyelets disposed at right angles to one another. One eyelet allows the head to be rotated about an axis perpendicular to the face thereby adjusting the lie. The other eyelet provides for the head to be rotated about an axis parallel to the face thereby adjusting the loft. Neither patent discloses any means for adjusting the offset of the putter.

Still other prior art putter designs utilize an augmented hosel, augmented shaft tip, or augmented shaft tip extension to provide an offset for a given putter. Three such designs are disclosed in U.S. Pat. No. 5,292,128. issued to Solheim, U.S. Pat. No. 5,320,346, issued to Phillips, and U.S. Pat. No. 5,267,733, issued to Szokola. However, none of these patents describe or suggest a method for varying the offset of a putter without reworking or modifying the configuration of the hosel, shaft tip or tip extension utilized in the original putter design.

It follows from the above that there is a need for an improved putter which allows for the lie angle and offset to be selectively set to accommodate individual golfers, their strokes and/or particular playing conditions. The putter should also have means for securely and reliably fixing the putter variables so that once set they cannot be changed during play. Moreover, the putter should be aesthetically pleasing and comfortable for the golfer to use.

SUMMARY OF THE INVENTION

The present invention is directed to an improved putter in which the lie and offset can be selectively set during assembly of the putter to suit golfers of different sizes and putting styles and is further directed to innovative lie and offset adapters for use in such putters, and to methods of assembling such putters.

In one innovative aspect, the present invention may enable a manufacturer to provide a full line of putters from which a golfer can find one that fits his or her particular needs (i.e., physical characteristics and putting style). Similarly, the present invention provides a means for adjusting the lie and offset of a putter to accommodate a given set of playing conditions resulting, for example, from the use of different types of grasses at different courses, or to accommodate modifications in a golfer's putting technique which may occur over time.

The putter of the present invention employs an innovative lie and offset adapter which allows for the lie angle and offset of a putter to be fixed to accommodate, for example, the physical characteristics or putting stroke of a given golfer. In addition, the utilization of adapters such as those described and claimed herein may enable putter manufacturers and retailers to better manage inventories, as surpluses and shortages of selected putter "styles" (i.e., putters having prescribed lie and offset characteristics) may be mitigated through adapter substitution.

Typically, a putter in accordance with the present invention has a longitudinal head with a heel and a toe, the heel being the end of the head closer to the golfer and the toe being the end positioned away from the golfer. A bored hosel is provided in the proximity of the heel and, depending upon the embodiment, may or may not extend through the putter head. A lower shaft segment is fixed within the bored hosel and is preferably oriented such that in the putting position, with the head of the putter horizontal to the putting surface, the lower shaft segment has a longitudinal axis which is substantially vertical. In other embodiments, the longitudinal axis of the lower shaft segment may be angled from the vertical orientation. Also, a hosel that extends from the putter head may replace the lower shaft segment or be used in combination with the lower shaft segment. An upper shaft segment is coupled to the lower shaft segment (or the extending hosel depending upon the embodiment) by an adapter in accordance with the present invention, such that the upper shaft segment has a longitudinal axis which is horizontally offset by a selected distance from the longitudinal axis of the lower shaft segment (and, therefore, has a longitudinal axis which is offset from a base edge of the putter face), and such that the longitudinal axis of the upper shaft segment achieves a selected lie angle with a line parallel to a flat putting surface. Finally, the upper shaft segment has an upper end which may include a grip for a golfer to hold the putter.

A lie and offset adapter in accordance with the present invention may comprise a short straight piece of metal, or spacer, which has formed on opposite ends and opposite surfaces an upper socket and a lower socket for engaging the upper and lower shaft segments respectively. In a preferred form, the sockets may be sized and shaped to mate with corresponding cavities formed in the upper and lower shaft segments, and the sockets may be glued or welded to the shaft segments. As for the relative position of the adapter, it is presently preferred that the spacer section of the adapter be positioned in a plane substantially parallel to the putting surface, and that the spacer section of the adapter extend forward of the putter face in a direction perpendicular to the longitudinal axis of the putter head, such that the length of the adapter may establish the amount of offset of the putter. In addition, the longitudinal axes of the sockets may be selectively oriented to achieve a predetermined lie angle. For example, in a preferred form the upper socket and upper shaft segment will share a common longitudinal axis, as will the lower socket and lower shaft segment. As the longitudinal axis of the lower shaft segment is preferably normal to the putting surface, the lie of the putter may be defined by the angle between horizontal and the common longitudinal axis of the upper socket and upper shaft segment. Accordingly, by changing the length of the adapter and the angular orientation of the upper socket (or both sockets if desired), the lie and offset of the putter may be varied.

Moreover, by interchanging the innovative adapter device, the lie and offset of a putter may be adjusted to a variety of settings to suit the needs of a broad range of golfers, and rather than having a full stock of different putters or putter styles, a putter manufacturer or retailer need only carry a stock of common putter components (i.e., putter heads, upper shaft segments, lower shaft segments, and grips) and several small adapters in order to provide a series of putters suitable to a broad variety of golfers. Moreover, a manufacturer may create a full line of putters with varying combinations of lies and offsets using virtually the same parts except that a differently configured adapter may be installed. Therefore, the same head and shaft segments can be used for a whole line of putters.

Accordingly, it is an object of the present invention to provide an improved putter.

It is another object of the present invention to provide an improved putter in which the lie and offset can be selectively set to suit a broad range of golfer's and putting styles.

It is still another object of the present invention to provide a lie and offset adapter for use in golf putters.

It is yet another object of the present invention to provide an improved method for manufacturing and assembling a golf putter.

DETAILED DESCRIPTION OF PREFERRED EMBODIMENTS

Figure 1:
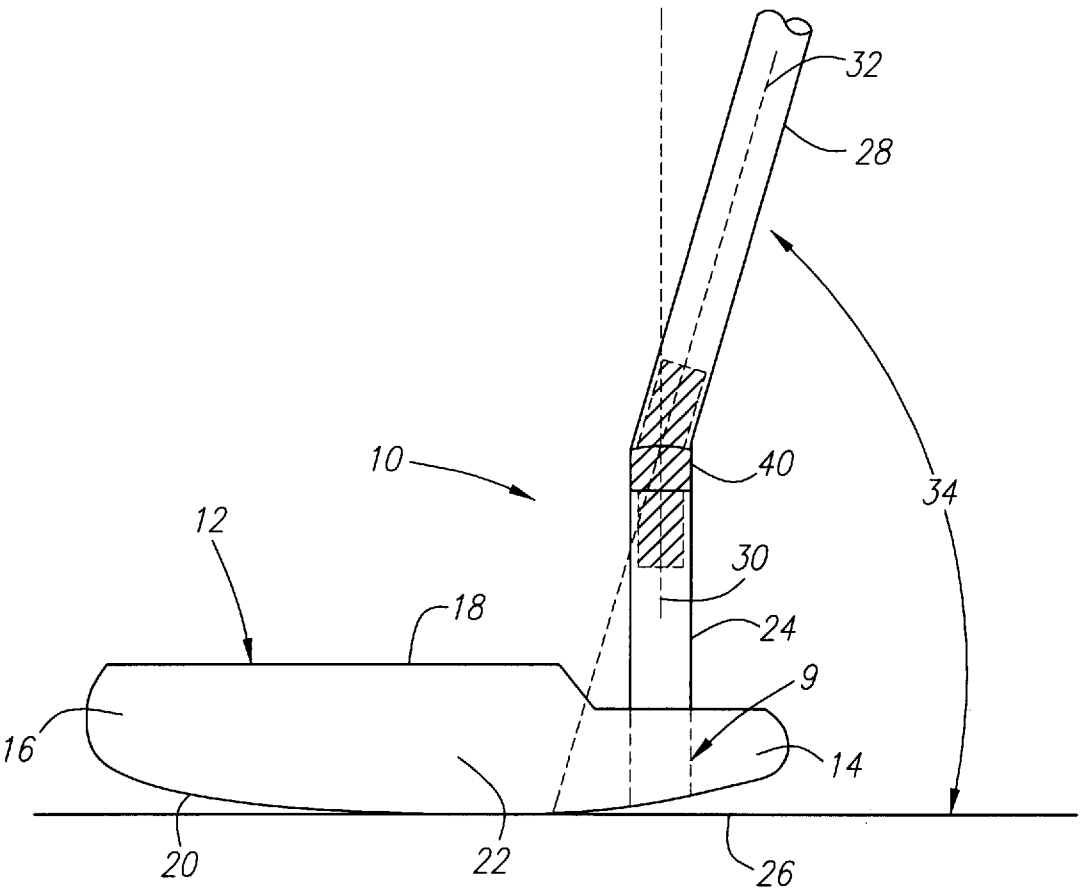
FIG. 1 is a front view looking at the face of a golf putter in accordance with a preferred embodiment of the present invention.

Turning now to the drawings, FIG. 1 shows a putter 10 in accordance with a preferred form of the present invention. The putter 10 comprises a longitudinal head 12 with a heel 14 and a toe 16, the heel 14 being the end of the head 12 positioned closer to a golfer during a putting stroke and the toe 16 being the end positioned away from the golfer. The head 12 of the putter further includes a top 18, a sole 20, and a face 22 for striking a golf ball. A lower shaft segment 24 may be connected to the head 12 in the proximity of the heel 14. For example, the lower shaft segment 24 may be inserted and fixed within a bored-through hosel 9 of the putter 10, as shown by dotted lines in FIG. 1. The lower shaft segment 24 typically comprises a metal or graphite, hollow tube and defines a lower shaft segment axis 30. The lower shaft segment axis 30 is preferably oriented such that in the putting position, with the head 12 of the putter 10 horizontal to a putting surface 26 (or parallel to a tangent to the putting surface), the lower shaft segment axis 30 is substantially vertical. In other embodiments, the lower shaft segment axis 30 may be angled from the vertical orientation. Further, as explained above, in some embodiments a hosel that extends from the putter head 10 may replace the lower shaft segment 24 or be used in combination with the lower shaft segment 24.

Figure 2:
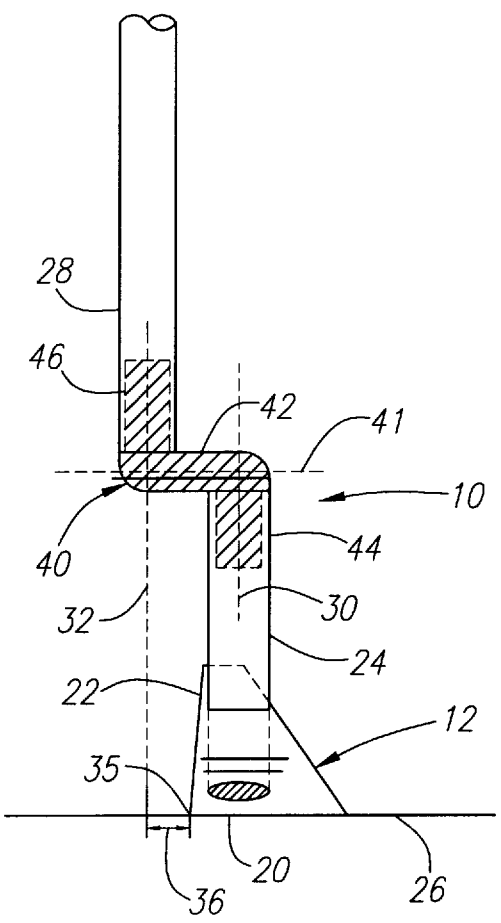
FIG. 2 is a heel side view looking at the heel of a golf putter in accordance with a preferred embodiment of the present invention.

As best seen in FIG. 2, an upper shaft segment 28 defining an upper shaft axis 32 may be positioned with the upper shaft segment axis 32 offset from the lower shaft segment axis 30. The amount of offset between the lower shaft segment 24 and the upper shaft segment 28 determines to a large extent the putter offset 36 which is the shortest distance between the upper shaft segment axis 32 and the base edge 35 of the face 22 of the putter 10.

Turning again to FIG. 1, the lie angle 34 of the putter 10 is preferably determined by the angular orientation of the upper shaft segment axis 32 with respect to a tangent (or parallel) to the putting surface 26 or, stated differently, with respect to horizontal. Like the lower shaft segment 24, the upper shaft segment 28 also typically comprises a metal or graphite, hollow tube. The upper shaft segment 28 has a first end which may include the usual grip (not shown) for a golfer to hold the putter.

Turning now also to FIG. 2, an innovative lie and offset adapter 40 may be provided between the two shaft segments 24 and 28 and fix the spacial and angular orientation of the two shaft segments 24 and 28. In a preferred form, the adapter 40 may comprise a spacer 42 and two cylindrical sockets 44 and 46, the cylindrical sockets 44 and 46 extending from opposite surfaces and opposite ends of the spacer 42. The spacer 42 may comprise a short, straight, flat piece of material, such as steel or aluminum, or it may be formed from composite materials such as graphite or carbon fiber, and the sockets 44 and 46 may be formed as a unitary piece with the spacer 42 or as separate components which may be fixed to the spacer 42. In a preferred form, the sockets 44 and 46 may be sized and shaped to mate with cavities (not shown) formed in the upper and lower shaft segments 24 and 28, and the sockets may be glued, welded or otherwise securely coupled to the shaft segments 24 and 28. As for the relative position of the lie and offset adapter 40, it is presently preferred that the longitudinal axis 41 of the spacer 42 be positioned in a plane substantially parallel to the putting surface 26 (or parallel to a tangent to the putting surface), and that the spacer 42 extend forward of the putter face 22 in a direction perpendicular to a longitudinal axis (not shown) of the putter head 12, such that the length of the spacer 42 may establish in substantial part the offset 36 of the putter 10.

In addition, the longitudinal axes 30 and 32 of the sockets 44 and 46 may be selectively oriented relative to each other to achieve a predetermined lie angle 34. For example, in a preferred form the upper socket 46 and upper shaft segment 28 will share a common longitudinal axis 32, as will the lower socket 44 and lower shaft segment 24. As the longitudinal axis 30 of the lower shaft segment 24 is preferably normal to the putting surface 26, the lie angle 34 of the putter 10 may be defined by the angle between horizontal and the common longitudinal axis 32 of the upper socket 46 and upper shaft segment 28. Accordingly, by changing the length of the spacer 42 (or adapter 40) and the angular orientation the upper socket 46 (or both sockets if desired), the lie angle 34 and offset 36 of the putter 10 may be selectively varied.

It will also be understood that by varying the length of the lower shaft segment 24 or hosel (not shown) the face balance of the putter 10 may be adjusted. This may also be achieved by varying the angular orientation of the longitudinal axis 32 of the upper socket 46 and upper shaft segment 28 with respect horizontal. Moreover, it is understood in the art that by varying the orientation of the upper socket 46 and/or the length of the lower shaft segment 24 (or hosel of the putter head) the degree of face balance of the putter may be modified.

In one preferred form, the lower socket 44 and upper socket 46 may be made of solid metal, such as steel or aluminum, and may be square in cross section. In such an embodiment, the lower socket 44 and upper socket 46 may be sized to fit within square cavities (not shown) formed inside end portions of the lower shaft segment 24 and upper shaft segment 28, respectively. The square shapes of the sockets 44 and 46 and cavities (not shown) provide alignment guides for assembling the putter 10 and provide positive resistance to rotation of the shaft segments 24 and 28 relative to the respective sockets 44 and 46. As is well known in the art, rotation of the shaft segments 24 and 28 is undesired because it may throw off the alignment of the putter 10.

In alternative embodiments, the sockets 44 and 46 and cavities formed within the shaft segments 24 and 28 may have round, oval, rectangular or other suitably shaped cross-sections. While a round shape does not assist in alignment and does not provide positive resistance to rotation during assembly, such a shape may more easily receive a standard shaft tip having a circular cross-section.

As pointed out above, the lower shaft segment 24 may be replaced by a hosel that extends from the putter head 10 or used in combination with a such a hosel. In one such embodiment, the open end of the hosel may extend from the head 12 of the putter 10 and be adapted to connect to the lower socket 44 of the adapter 40, for example, in the manner described above.

In still another embodiment (not shown in the figures), the adapter 40 may comprise a spacer 42 having a pair of bosses formed on opposite surfaces and opposite ends thereof. Like the sockets 44 and 46 described above, the bosses may comprise a unitary piece with the spacer 42 or be fixedly attached to the spacer 42. In such an embodiment, the bosses may be adapted to receive and engage the ends of the shaft segments 24 and 28, and to thereby define the spacial and angular orientation of the shaft segments 24 and 28. It follows that the use of a pair of bosses in place of the sockets 44 and 46 would be considered an equivalent substitution of elements.

In still another embodiment (also not shown in the figures), the adapter 40 may comprise a spacer 42 that has formed on opposite surfaces and opposite ends a pair of flat surfaces which may be fit against respective ends of the upper and lower shaft segments 24 and 28. In such an embodiment, the ends of the upper and lower shaft segments 24 and 28 may be fixed to the spacer 42 by means of screws, bonding or other suitable means, and again the spacial and angular orientation of the flat surfaces may define the lie and offset of the putter 10.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A golf putter comprising a putter head having a face for striking a golf ball, an upper shaft segment having an upper end portion and a lower end portion, a lower shaft segment having an upper end portion and a lower end portion, said lower end portion of said lower shaft segment connected to said putter head, and an adapter for setting the lie and offset of the putter, said adapter comprising a spacer, an upper connector and a lower connector, said upper connector extending from a first surface of said spacer and coupling with the lower end portion of said upper shaft segment, said lower connector extending from a second surface of said spacer and coupling with the upper end portion of said lower shaft segment, said spacer extending longitudinally in a direction that is substantially parallel to a direction of forward motion of the putter head such that the upper shaft segment is forward of the lower shaft segment, wherein said upper connector comprises a socket adapted to mate with a first cavity formed in the lower end portion of said upper shaft segment and said lower connector comprises a socket adapted to mate with a second cavity formed in the upper end portion of said lower shaft segment.

2. The golf putter of claim 1, wherein said sockets and said first and second cavities have square shaped cross sections.

3. The golf putter of claim 1, wherein said sockets and said first and second cavities have round cross sections.

4. The golf putter of claim 1, wherein said sockets and said first and second cavities have oval cross sections.

5. The golf putter of claim 1, wherein said sockets and said first and second cavities have polygonal cross sections.

6. A method of assembling a golf putter, the method comprising the steps of:

providing a plurality of substantially identical putter heads;

providing a plurality of substantially identical upper shaft segments;

providing a plurality of substantially identical lower shaft segments;

providing a plurality of lie and offset adapters, at least two of said plurality of lie and offset adapters defining different putter lie and offset characteristics;

selecting from said plurality of lie and offset adapters and adapter defining predetermined lie and offset characteristics;

fixing said selected adapter to a first end of one of said plurality of substantially identical upper shaft segments;

fixing said adapter to a first end of a selected one of said plurality of substantially identical lower shaft segments such that the upper shaft segment is forward of the lower shaft segment relative to a direction of forward motion of the putter head; and fixing a second end of said selected lower shaft segment to one of said substantially identical putter heads, wherein each of said lie and offset adapters comprises a spacer having a first surface and a second surface opposite said first surface, a first socket extending from said first surface along a first longitudinal axis, and a second socket extending from said second surface along a second longitudinal axis.

7. A method of assembling a golf putter, the method comprising the steps of:

providing a plurality of substantially identical putter heads, each putter head having a face, a toe, a heel and a hosel extending from a heel region of said putter head;

providing a plurality of substantially identical upper shaft segments;

providing a plurality of lie and offset adapters, at least two of said plurality of lie and offset adapters defining different putter lie and offset characteristics;

selecting from said plurality of lie and offset adapters and adapter defining predetermined lie and offset characteristics;

fixing said selected adapter to a first end of one of said plurality of substantially identical upper shaft segments; and fixing said adapter to the hosel of one of said substantially identical putter heads such that the upper shaft segment is forward of the hosel relative to a direction of forward motion of the putter head, wherein each of said lie and offset adapters comprises a spacer having a first surface and a second surface opposite said first surface, a first socket extending from said first surface along a first longitudinal axis, and a second socket extending from said second surface along a second longitudinal axis.

* * * * *